United States Patent [19]

Wolff

[11] Patent Number: 4,576,377

[45] Date of Patent: Mar. 18, 1986

[54] ATHLETIC EXERCISER ASSEMBLY

[76] Inventor: Leslie C. Wolff, Box 188, Lakeview Dr., Hackensack, Minn. 56452

[21] Appl. No.: 765,717

[22] Filed: Aug. 15, 1985

Related U.S. Application Data

[63] Continuation of Ser. No. 554,820, Nov. 23, 1983, abandoned.

[51] Int. Cl.[4] ..... A63B 21/00

[52] U.S. Cl. ..... 272/130; 272/134

[58] Field of Search ..... 272/73, 93, 117, 118, 272/130, 134, 136, 143, 144, DIG. 4; D21/195

[56] References Cited

U.S. PATENT DOCUMENTS

| | | | |
|---|---|---|---|
| D. 230,613 | 3/1974 | Niguel et al. | 272/130 X |
| 3,128,094 | 4/1964 | Wolf | 272/130 X |
| 3,359,802 | 12/1967 | Sollenberger | 272/130 X |
| 3,465,592 | 9/1969 | Perrine | 272/130 X |
| 3,647,209 | 3/1972 | LaLanne | 272/118 |
| 3,713,653 | 1/1973 | Romans | 272/134 |
| 3,822,599 | 7/1974 | Brentham | 272/130 X |
| 3,850,431 | 11/1974 | Winans | 272/134 X |
| 3,912,265 | 10/1975 | Muir | 272/130 |
| 4,072,309 | 2/1978 | Wilson | 272/136 |
| 4,291,787 | 9/1981 | Brentham | 272/130 X |
| 4,332,381 | 6/1982 | Lyons | 272/144 |
| 4,397,462 | 8/1983 | Wilmarth | 272/130 |
| 4,422,636 | 12/1983 | De Angeli | 272/117 |
| 4,492,375 | 1/1985 | Connelly | 272/134 |

FOREIGN PATENT DOCUMENTS

| | | | |
|---|---|---|---|
| 2501050 | 9/1982 | France | 272/130 |
| 1153143 | 5/1969 | United Kingdom | 272/130 |

*Primary Examiner*—Richard J. Apley
*Assistant Examiner*—Robert W. Bahr
*Attorney, Agent, or Firm*—Keith T. Bleuer

[57] ABSTRACT

An athletic exercising device comprising a handle mounted on swing arms pivotally mounted on a support tube that is vertically moveable on an upstanding standpipe and a spring loaded set pin for adjustably fixing the support tube in desired vertical positions on the standpipe. A piston-cylinder assembly is carried by the tube, and a closed hydraulic circuit is connected to the two ends of the cylinder. A piston rod is connected to the piston of the assembly and to the swing arms so that the arms and handle can be moved for exercising purposes against the action of the fluid acted on by the piston. The tube allows the assembly to be inverted on the standpipe and also to be rotated on the standpipe through 180 degrees for different exercises.

8 Claims, 6 Drawing Figures

ATHLETIC EXERCISER ASSEMBLY

CROSS-REFERENCES TO RELATED APPLICATIONS

This application is a continuation of my application entitled "Athletic Exerciser", Ser. No. 554,820, filed Nov. 23, 1983 now abandoned.

BACKGROUND OF THE INVENTION

The invention relates to athletic exercise equipment and more specifically to such equipment having bars or handles which may be gripped manually and which are connected to motion-restraining apparatus so that the bars or handles may be moved against the restraining apparatus in order to exercise a person's arms and other body parts.

Exercising machines have previously been proposed which include an upright standard, an arm carrying a handle swingingly disposed on the standard, restraining means for restraining movement of the arm and handle so as to exercise various muscles, particularly arm muscles, and a bench also fixed onto the standard at one end and supported by legs at its other end so that the person exercising may be seated at the time on the bench. The restraining means for the handle and arms have included spring cords that provide tension biasing means, and these cords are effective on the swingable arms. Such an exercising device is disclosed in Wilson U.S. Pat. No. 4,072,309 issued Feb. 7, 1978.

Other exercising devices have provided a handle pivotally mounted on a frame with a hydraulic system connected to the handle to exert a regulated force restraining movement of the handle, and such a device is disclosed in Brentham U.S. Pat. No. 3,822,599 issued July 9, 1974.

In my prior U.S. Pat. No. 4,482,152, I also disclose an exercising device which includes a hydraulic cylinder which provides a restraint on manually actuatible handles. The hydraulic cylinder is located in the bottom of the machine and is connected with the handles by means of force transmitting mechanism including chains.

SUMMARY OF THE INVENTION

It is an object of the present invention to provide an improved exerciser which is simplified in construction and is versatile in that it can be adjusted to be suitable for providing many different exercises of the body, including standing exercises, prone exercises and seated exercises, and including also exercises in which an exercise bar is manually moved upwardly or downwardly against a resistance.

In a preferred form, the exerciser of the invention includes a vertical standpipe and an upper head and cylinder assembly which includes a mounting tube encircling the standpipe and being thus adjustably vertically moveable on the standpipe. The head and cylinder assembly includes a pair of swing arms swingably mounted on braces that are fixed to the tube and having a handle on their remote ends, a piston-cylinder assembly swingably mounted on the braces and having a piston rod connected to it that is swingably mounted on its distal end with respect to the swing arms. The cylinder has a conduit connecting its two ends with a valve in the conduit so that the motion of the piston in the cylinder may be governed by the opening of the valve so that a greater or less resistance to movement of the swing arms may be provided for exercising against a greater or less resistance. The tube of the head and cylinder assembly may be withdrawn from the standpipe, then inverted, and finally returned to the standpipe in inverted relationship so that resistance of movement of the handle in the opposite direction is provided. A bench is provided beneath the swing arms and is supported at its two ends, with the support at one end being releasable so that the bench may decline from horizontal for particular exercises. The tube of the head and cylinder assembly allows the assembly to be rotated through 180 degrees from its original position in which the exercise arms overlie the bench so that a pair of opposite grips carried by the braces may lie forwardly of the standpipe to be used either manually or pedially for braces during sit-up and leg lift exercises in particular.

DESCRIPTION OF THE PREFERRED EMBODIMENT

Figure 1:
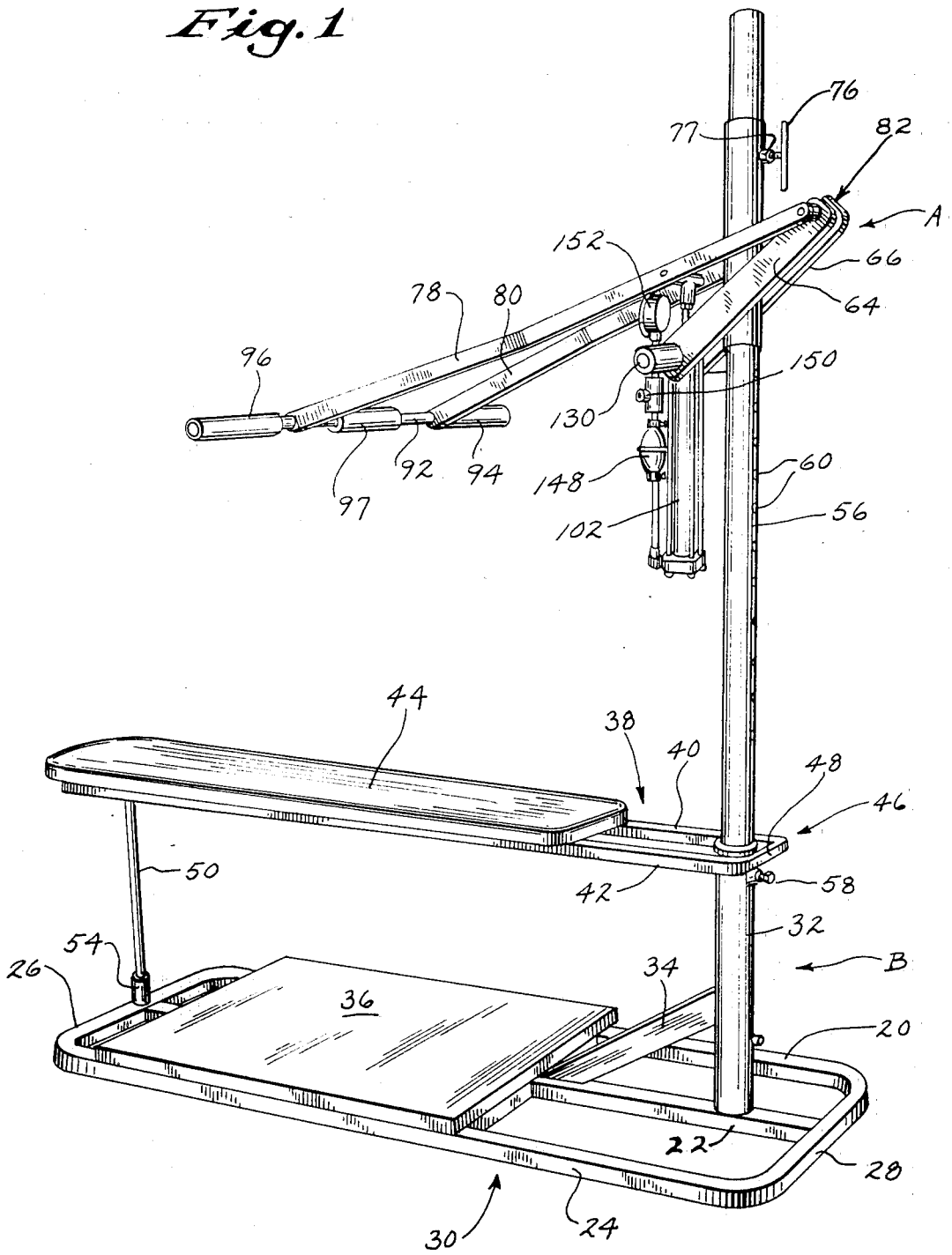
FIG. 1 is a perspective view of the exerciser of the invention which includes a lower bench and frame assembly and an upper head and cylinder assembly supported by the bench and frame assembly.

Referring now to FIG. 1 in particular, the illustrated exerciser may be seen to comprise a lower bench and frame assembly B and an upper head and cylinder assembly A which is supported by the assembly B. The assembly B may be seen to comprise three parallel, relatively long bars 20, 22 and 24 connected at their ends by a pair of relatively short bars 26 and 28. These bars are all fixed with respect to each other and together form a coplanar bottom support or ground supported base 30 that is adapted to rest on a flat surface, such as a floor, with all of the bars in contact with the flat surface. An upstanding support tube 32 is fixed as by welding to the bar 22 at right angles to the bar 22 and is braced with respect to the bar 22 by means of a brace 34 that is welded to the tube 32 and to the bar 22. A platform 36 is disposed on top of the bars 20, 22 and 24 as shown in FIG. 1 and is fixed to these bars in any suitable manner.

A bench 38 is pivotally mounted to the tube 32 at its upper end and comprises two parallel relatively long bars 40 and 42. The bars 40 and 42 are connected together at their ends, extend parallel with respect to the bars 20, 22 and 24 and support an elongated seat pad 44. The pivot 46 functions to pivotally mount the bench 38 with respect to the tube 32 and comprises a tube 48 welded to the upper end of the tube 32 and a rod extending between the two forward ends of the bars 40 and 42 and through the tube 48.

A support bar 50 is pivotally mounted on the rear end of the bench 38 by means of a pivot rod 52 (see FIG. 2) that extends into both of the bars 40 and 42, and an upstanding insert tube 54 is welded to the bar 26 for receiving the lower end of the bar 50 when the bench 38 is in upraised position as will be more fully described hereinafter.

Figure 2:
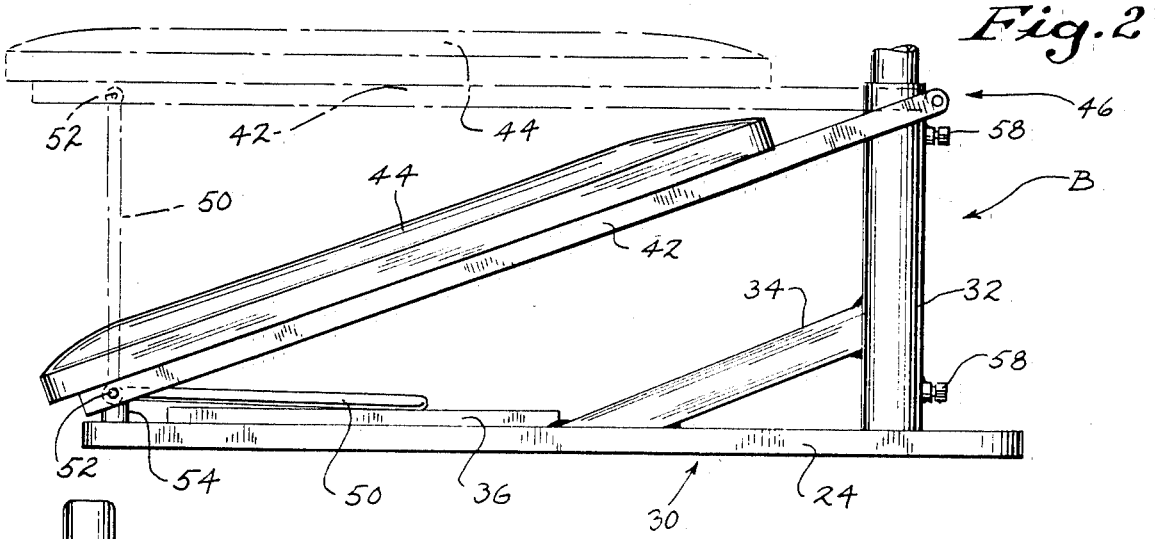
FIG. 2 is a side elevational view of the bench and frame assembly.

The assembly B comprises also a vertical post in the form of a standpipe 56 that extends into the tube 32 and is fixed therein by means of the set screw 58. The standpipe 56 has spaced openings 60 in it (see FIG. 3) that are disposed opposite to the bench 38 as the exerciser is illustrated in FIG. 2 and that cooperate with the assembly A as will be described.

Figure 3:
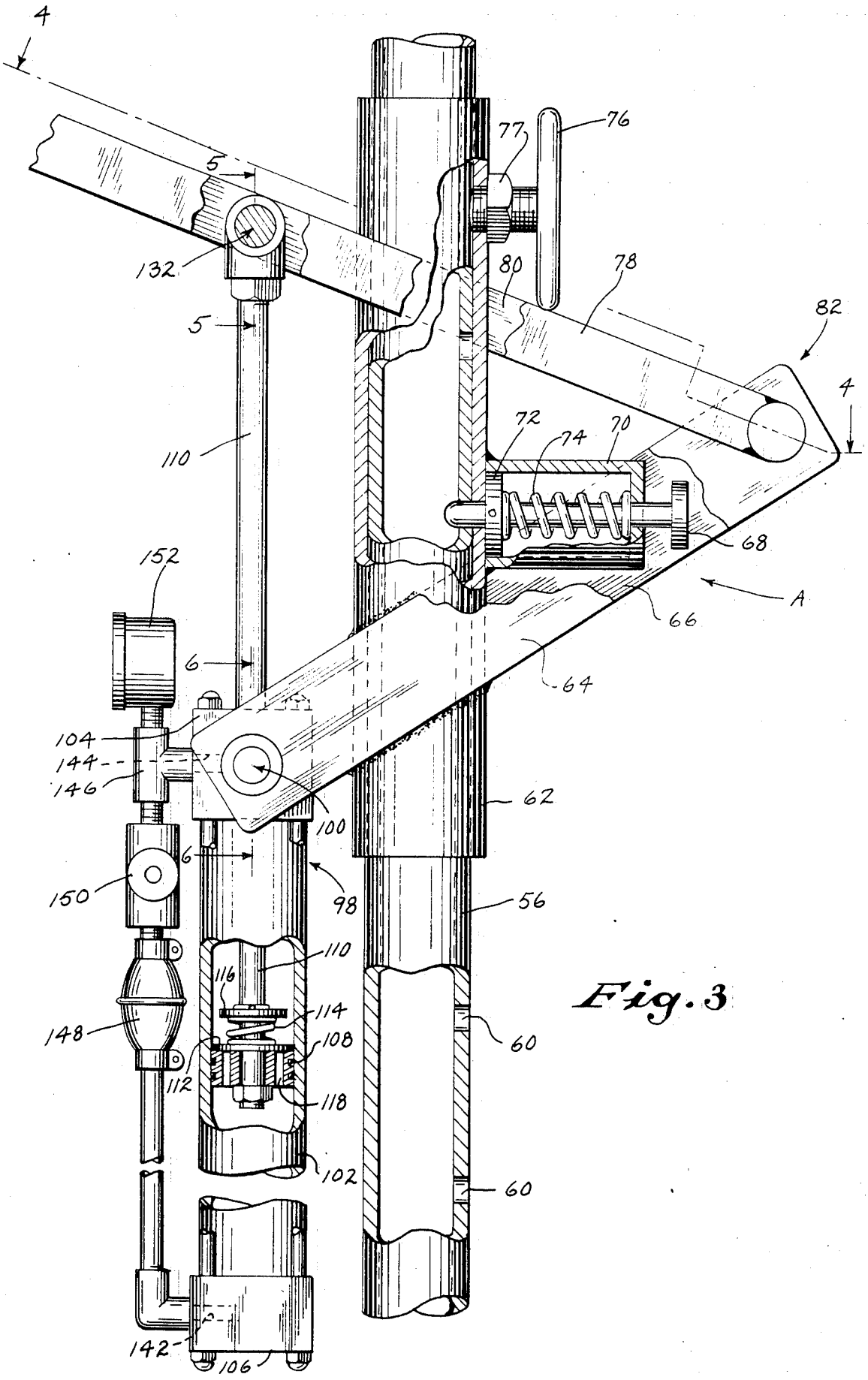
FIG. 3 is a side elevational view of the head and cylinder assembly.

The assembly A comprises an external tube 62 that is somewhat loosely disposed about the standpipe 56. A pair of support braces 64 and 66 are welded on opposite sides of the tube 62 and extend diagonally upwwardly from left to right as the assembly is shown in FIGS. 1 and 3. A set pin 68 is disposed between the braces 64 and 66 and is contained in a housing 70 that is welded onto the tube 62. A washer 72 is fixed on the pin 68, and a compression spring 74 is disposed between the washer 72 and the opposite end of the housing 70. The tube 62 is provided with an opening through which and through an aligned opening 60 the pin 68 may extend as shown in FIG. 3. A set screw 76 extending through a nut 77 and through an aligned opening in the tube 62 is provided to be effective on the pipe 56. The nut 77 is welded to the tube 62 in such a position vertically that the set screw 76 is effective between a pair of the holes 60 when the set pin 68 is positioned in one of the holes 60.

Figure 4:
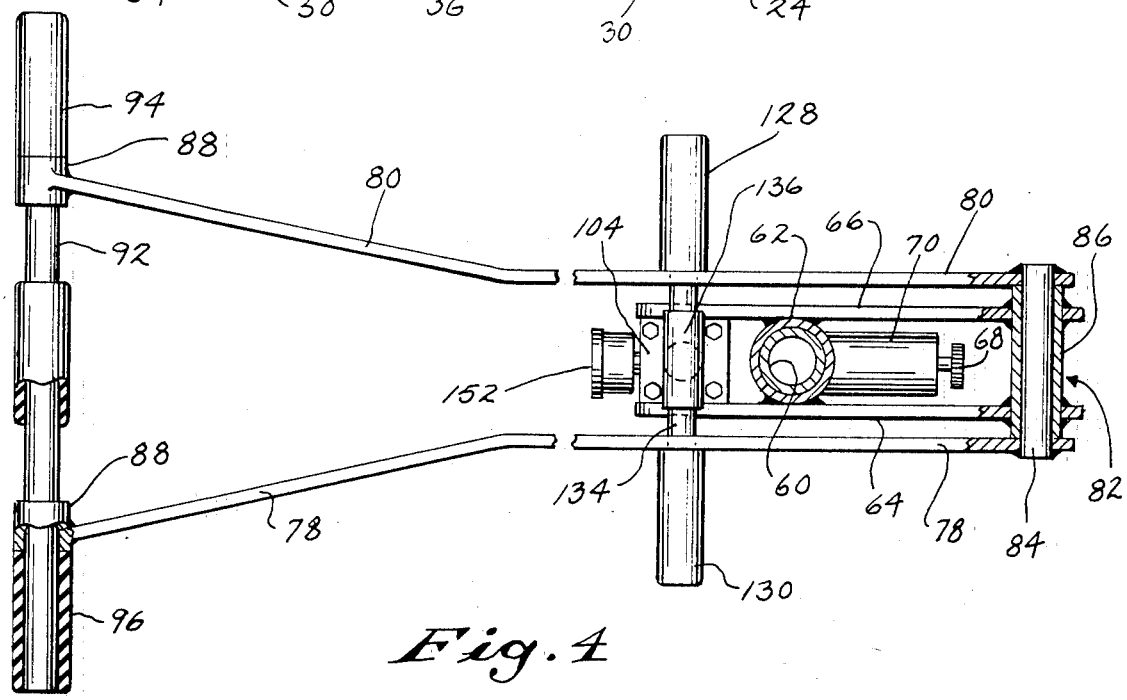
FIGS. 4, 5 and 6 respectively are sectional views taken on lines 4—4, 5—5 and 6—6 of FIG. 3.

A pair of spaced exercise arms 78 and 80 are pivoted on the upper ends of the braces 64 and 66 by means of a pivot 82. As shown in FIG. 4, the pivot 82 comprises a rod 84 to which opposite ends of the exercise arms 78 and 80 are welded and a tube 86 loosely disposed over the rod 84. The tube 86 extends through upper ends of the braces 64 and 66, and the braces 64 and 66 are welded to the tube 86. It will be noted from FIG. 4 in particular that the housing 70 and the pin 68 extend from the tube 62 toward the rod 84 and the tube 86 and further that the pin 68 has an enlarged end adjacent the tube 86 for handling purposes as will be described.

Tubular portions 88 and 90 are welded to the rear ends of the arms 78 and 80, and a round handle bar 92 extends loosely through the tubular portions 88 and 90. Tubular hand grips 94 and 96 of rubber-like material are fixed on the ends of the bar 92 and a similar hand grip 97 is disposed on the center of the bar 92 so as to complete a means for moving the bars 78 and 80 for exercising purposes.

A hydraulic piston-cylinder assembly 98 is swingably mounted between the lower ends of the braces 64 and 66 by means of a pivot 100. The assembly 98 comprises a hollow tube 102, end closures or heads 104 and 106 for the tube 102 and a piston 108 slidably disposed in the tube 102. The piston 108 is sealed with respect to the inner surface of the tube by rubber rings, as is conventional with hydraulic piston-cylinder assemblies. A piston rod 110 is fixed to the piston 108 and extends through the head 104. A valve disk 112 is slidably disposed on the rod 110 and fits against the upper surface of the piston 108. The disk 112 is held in such position with respect to the piston 108 by means of a compression spring 114 disposed between the disk 112 and a lock ring 116 that is fixed on the rod 110. Holes 118 are provided through the piston and are positioned to be closed by the valve disk 112.

Figure 6:
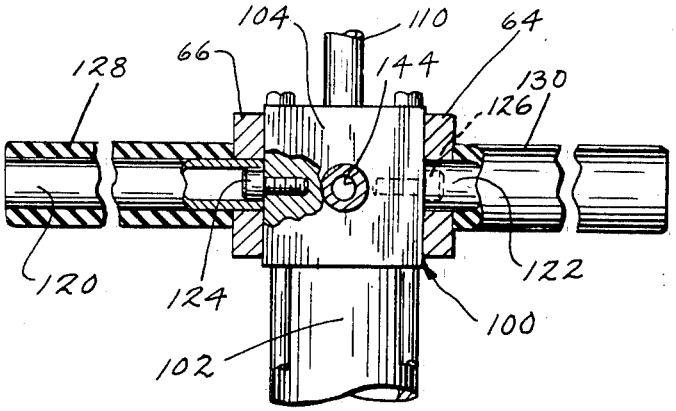

The pivot 100 comprises a pair of rods 120 and 122 that extend at right angles to and are welded to the braces 64 and 66 as shown in FIG. 6. Pins 124 and 126 are rotatably disposed in the facing ends of the rods 120 and 122 and are screwed into the head or closure 104. Since the pins 124 and 126 are rotatable in the ends of the rods 120 and 122, the head 104 may swing with respect to the braces 64 and 66 for purposes to be described. As is evident from FIG. 6, the rods 120 and 122 extend sidewardly for considerable distances from the braces 64 and 66, and handle grips 128 and 130 of rubber-like material are disposed over and are fixed with respect to the rods 120 and 122.

Figure 5:
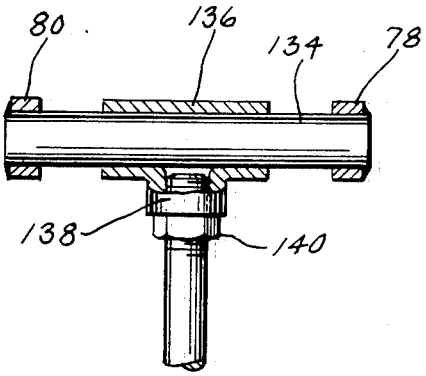

A pivotal connection 132 is provided between the arms 78 and 80 and the upper end of the piston rod 110. The connection 132 comprises a rod 134 which is disposed in opposite openings provided in the arms 78 and 80 and which is welded in these openings (see FIG. 5). A tube 136 fits loosely on the rod 134 and has a downwardly extending extension 138. The upper end of the piston rod 110 is screw threaded into the extension 138, and a lock nut 140 holds the rod 110 and tube 136 in assembled relationship.

The hydraulic circuit for the piston-cylinder assembly 98 comprises passages 142 and 144 provided in the end closures 104 and 106 for the cylinder 102. A T-pipe 146 is connected with the passage 144, and a hydraulic conduit 148 is connected with the passage 142. The conduit 148 is connected with the valve 150 which in turn is connected with the T-pipe 146 to complete the hydraulic circuit from one end of the tube 102 to the other. A pressure gauge 152 is disposed on the upper end of the T-pipe 146 for measuring the hydraulic pressure in the T-pipe for purposes to be described.

During the operation of the exerciser, the bench (38) may be either horizontal, as shown in FIG. 1, or may be declined as shown in FIG. 2. When bench 38 is in horizontal position, the rear end of it (remote from the tubes 32 and 56) is held raised with respect to the bottom support 30 by means of the support bar 50 which rests in the insert tube 54 which holds the bar 50 in vertical disposition at this time. When it is desired that the bench 38 shall be in declined disposition, the bench 38 is raised slightly pivoting about the pivot 46; the bar 50 is swung underneath the bench 38; and the bench 38 pivots downwardly until it rests on the upper end of the insert tube 54. These two positions of the bench 38 are used for various exercises using the exerciser of the invention as will be described.

When the arms 78 and 80 are used for exercising, these arms are pivotally moved up and down about the pivot 82 which is fixed with respect to the tube 62 by virtue of the welding attachment of the support braces 64 and 66 to the tube 62. The piston rod 110 has the pivotal connection 132 with the arms 78 and 80; and thus, as the arms 78 and 80 are pivoted upwardly on the pivot 82, the piston rod 110 is pulled outwardly of the piston-cylinder assembly 98 and its tube 102. The conduit 148 and the passages 142 and 144 provide an open connection between the two ends of the tube 102 which is closed on its two ends by closures 104 and 106, the flow of hydraulic fluid through this closed circuit being impeded only by the valve 150 which may be more or less closed for impeding the fluid flow as desired. The piston 108 being fixed to the rod 110 moves upwardly with the rod 110, and the valve disk 112 is in position closing the holes 118 provided through the piston so that fluid flow occurs from the upper end of the piston-cylinder assembly 98 and through the passage 144, the T-pipe 146, the valve 150, the conduit 148 and the passage 142 to the lower end of the piston-cylinder assembly 98. Depending on the amount that the valve 150 is closed, this flow is more or less impeded, and there is a resulting resistance to movement upwardly of the piston 108 and piston rod 110. When the piston rod 110 and piston 108 are moved in the opposite direction, downwardly as shown in the figures, the valve disk 112 moves out of contact with the piston 108 opening the passages 118 so that fluid flow may occur without substantial restriction through the holes 118 from the lower surface of the piston 108 to its upper surface. This movement of the piston rod 110 and the piston 108 thus is substantially unimpeded, requiring little force. With the parts being in their illustrated postions in FIG. 3, it is contemplated that the weight of the arms 78 and 80 shall be enough to cause a downward movement of the rod 110 and the piston 108 with respect to the piston-cylinder assembly 98. During the upward movement of the rod 110 and piston 108, the pressure in the passage 144 and in the T-pipe 146 and thus effective on the upper surface of the piston 108 is indicated by the reading on the pressure gauge 152 connected to the T-pipe 146, this being a measure of the force required for a raising of the rod 110 and piston 108 and thus of the effort required for this purpose. Since the arms 78 and 80 are pivoted on pivot 82, the rod 110 does not move directly vertically during the swing of the arms 78 and 80, and the pivot 100 allows a slight swinging of the piston-cylinder assembly 98 and thus accommodates the movement of the pivot 132 in a slight arc about the pivot 82 with swinging movement of the arms 78 and 80.

The assembly A may be raised or lowered on the standpipe 56 to put the assembly A in different vertical positions. The set pin 68 holds the assembly A in different vertical positions on the standpipe and in each case the pin 68 is disposed in one of the spaced openings 60 in the standpipe 56. The handle grips 128 and 130 disposed on the rods 120 and 122 form an easy mechanism for raising the assembly A while at the same time releasing the set pin 68 which as will be noted from FIG. 3 is located slightly downwardly from the pivot 82. The two hands of a person may be used to grip one of the grips 128 and 130 and the tube 86 on opposite sides of the pipe 56 for providing an upward force on the assembly A, and at the same time one of the fingers of the hand on the tube 86 may be used for pulling the set pin 68 outwardly with respect to one of the openings 60 to release the tube 62 with respect to the standpipe 56. Then the assembly A is raised to its desired location on the standpipe 56, and the set pin 68 is allowed to enter another one of the openings 60 under the influence of the return spring 74. A downward movement of the assembly A is accomplished in essentially the same way by using the two hands on opposite sides of the pipe 56 to hold the assembly A against unrestrained downward movement while at the same time releasing set pin 68 from an opening 60 and then allowing the assembly A to descend to its desired height while allowing the set pin 68 to again enter an opening 60. The set screw 76 may be used for tightening the tube 62 on the standpipe 56 in any of the particular positions of the assembly A on the standpipe 56 determined by the set pin 68 disposed in any of the openings 60. As will be described, the rods 120 and 122 and the grips 128 and 130 also provide an anchor for the two feet or two hands of a person for certain exercising in addition to their function of providing readily accessible handles for raising and lowering the assembly A on the standpipe 56.

For certain exercising, the assembly A may be rotated about the standpipe 56 for 180 degrees so as to move the arms 78 and 80 and the piston-cylinder assembly 98 in front of the standpipe 56. The set screw 76 and set pin 68 are released for this purpose, and using the handles provided by the rods 120 and 122 and the grips 128 and 130, the assembly A is swung through 180 degrees so as to move the piston-cylinder assembly 98 and the arms 78 and 80 in front of the standpipe 56. The rods 120 and 122 and grips 128 and 130 are then used for bracing the feet or hands for certain types of exercise as will be described; and, for this purpose, the tube 62 is allowed to move downwardly to the limit of its movement in contact with the upper end of the tube 32.

For other exercises, the assembly A may also be inverted on the standpipe 56. This is accomplished by releasing the set pin 68 and set screw 76, moving the tube 62 and the rest of the assembly A upwardly out and away from the standpipe 56 and then moving the tube 62 again back on to the standpipe 56 after inverting the tube 62 and the rest of the assembly A. Under these conditions, the set screw 76 is at the bottom, and the set pin 68 is at the top. The assembly A may then be fixed with respect to the tube 56 in the same manner as before, allowing the set pin 68 to move into one of the openings 60 to fix the assembly A in its inverted position on the standpipe 56.

Many different exercises may be performed using the exerciser of the invention. One of these exercises is the behind-the-neck press, and for this exercise the parts of the exerciser are substantially in the same dispostions as shown in the drawings. The bench 38 is horizontal, being supported by the bar 50, and the tube 62 of the assembly A is located close to the upper end of the standpipe 56. One free opening 60 may exist between the upper end of the standpipe 56 and the upper end of the tube 62 (there may be, for example, eleven of the holes 60, for example). When the tube 62 is resting on the tube 32 for exercises to be hereafter described, the set pin 68 is within the lowermost of the openings 60.

For the behind-the-neck press exercise, the person sits on and straddles the bench 38, facing rearwardly (away from the standpipe 56). The bar 92 is initially about the level of the person's head, and the exercise arms 78 and 80 are at this time substantially horizontal. With this exercise, the person holds his elbows outwardly so that his arms extend upwardly and slightly toward each other for his hands to grip the opposite handles 94 and 96. The person then moves the bar 92, holding the handles 94 and 96 with the opposite hands, behind his head and neck, this movement being substantially against no resistance since the piston 108 is descending the cylinder 102 at this time and the fluid raises the disk 112 off the upper surface of the piston 108 allowing fluid to freely flow through the holes 118. The person then raises the handle 92 and arms 78 and 80 against the action of the fluid in the cylinder 102, and the fluid flows through the hydraulic circuit from the passage 144, through the valve 150 and conduit 148 and finally through the passage 142 to the bottom end of the cylinder 102. The restriction provided by the valve 150 determines the amount of force necessary to raise the handle 92 and arms 78 and 80. The arms 78 and 80 pivot about the pivot 82, and the tube 102 pivots slightly about the pivot 100, since the pivotal connection 132 moves in a slight arc. With this exercise, the deltoid (anterior), trapezius, and triceps muscles are exercised.

The tricep extensor exercise is one using the exerciser parts in substantially the same dispositions with respect to each other. With the tricep extensor exercise, the user sits on the rear end of the bench 38 and faces rearwardly, and the upper arms are substantially vertical, and the forearms are substantially horizontal and reach back to the center of the handle 92 on the grip 97. Holding the upper arm portions substantially vertical, the person moves the handle 92 and arms 78 and 80 upwardly flexing the elbow joints, this being against the resistance of the piston 108 in moving upwardly in the tube 102. With this exercise, the triceps and deltoid muscles are exercised.

For the toe raise exercise, the assembly A is located substantially at its height as shown in FIG. 1 on the standpipe 56, and the bench 38 is allowed to decline by swinging the support bar 50 to underlie the seat pad 44 so that the rear end of the bench 38 rests on the insert tube 54. The person stands and straddles the bench 38 in its declining disposition and puts his head between the exercise arms 78 and 80 so that these arms rest on his shoulders. He then raises himself on tiptoe against the action of the piston 108, thus exercising the gastrocnemius, soleus, peroneus and tibialis muscles.

The squat exercise may be used with the parts of the exerciser substantially as just described, with the bench 38 being declining. The person straddles the bench 38 facing forwardly and standing, has his knees and trunk at the waist bent, with his head extending through the opening between the exercise arms 78 and 80. His hands are on the grips 94 and 96, and he straightens his body against the restraining action of the piston-cylinder assembly 95, thus exercising in particular the gluteus maximus, quadriceps femoris, biceps femoris and adductor longus muscles.

With the parts of the exerciser being in the same relative positions as just mentioned, but with the bench 38 being horizontal, the leg press exercise may be accomplished. In this exercise, the person exercising rests horizontally on the bench 38 with the legs facing forwardly and upwardly. The legs are flexed to raise the bar 92 and arms 78 and 80 upwardly against the action of the piston 108, thus exercising the gluteus maximus, quadraiceps vemoris, biceps femoris and adductor longus muscles.

For the front press exercise, the tube 62 is adjusted downwardly for the distance between two of the openings 60 so that the set pin 68 moves into the next lower opening 60. Otherwise, the parts of the exerciser are in substantially the same relative dispositions as for the leg press exercise just described. For the front press exercise, the person straddles and sits on the bench 38 facing forwardly (toward the standpipe 56) and raises the handle 92 and arms 78 and 80 against the restraining action of the piston 108 by flexing actions of his arms. With this exercise, the deltoid (posterior), trapezius and triceps muscles are exercised.

The bicep curl exercise is done with the assembly A lowered on the standpipe 56 so that the arms 78 and 80 are horizontal slightly above waist level. The bench 38 is horizontal, and the person exercising stands and straddles the bench and applies his hands underneath the bar 92 and on grip 97. The arms are used to elevate the handle 92 against the action of the piston 108, and the biceps brachii and deltoid (anterior) muscles are exercised.

The upright row exercise is done with the parts of the exerciser in the same dispostions as just mentioned for the bicep curl exercise. In this case, the bar 92 is below the arms of the person and the hands are placed between the arms 78 and 80 on the grip 97. The handle 92 is then repetitively raised by flexing the elbows in particular. The deltoid and trapezius muscles are exercised.

The bench press exercise is accomplished by moving the assembly A downwardly from its position from the previous upright row exercise so that it is slightly below the center of the standpipe 56 and with the bench 38 being horizontal. The person exercising lies flat on the pad 44 with his head at the forward end of the pad 44 and with his legs extending downwardly to the floor with his feet flat on the floor. The person then flexes his arms and using the handles 94 and 96 raises the arms 78 and 80 against the action of the piston 108. The pectoralis major, serratus anterior and deltoid (anterior) muscles are thus exercised.

The side bend exercise is accomplished using the parts of the exerciser in the same relative dispositions as just mentioned except that the assembly A is lowered to some extent on the standpipe 56. The person exercising pulls one of the handles 94 with the left hand and twists to the side against the action of the piston 108 to thus exercise the external obliques and internal obliques muscles. This exercise may also be done with the other hand.

The bent-over row exercise is performed with the tube 62 moved downwardly to the limit of its movement and with the bench 38 being declined. The person exercising stands and faces forwardly (toward the standpipe 56) and bends forwardly straddling the bench. He then, with his arms bent, straightens up and pulls the arms 78 and 80 upwardly against the action of the piston 108 thus exercising the latissimus dorsi, teres major, and lower trapezius muscles.

The dead lift exercise is accomplished with the parts of the exerciser in the same relative dispositions as just mentioned for the bentover row exercise except that the arms 78 and 80 are about horizontal instead of inclined upwardly. The person exercising is bent over with his arms straight and lifts the bar 92 using the hand grips 94 and 96, pretending that the bar 92 is the bar of a barbell. The seratus posterior, lumbodorsal, gluteus maximus, erector spinae and biceps femoris muscles are thereby exercised.

The lat pulldown (front), lat pulldown (rear), and tricep pushdown exercises are accomplished with the assembly A being inverted on the standpipe 56 so that the piston-cylinder assembly 98 is inverted and has its end closure 106 at the top. For the lat pulldown (front) exercise, the tube 62 is positioned on the standpipe 56 close to the upper end of the standpipe, and the bench 38 is horizontal. The person exercising straddles and sits on the bench, facing forwardly; and he uses his hands on the bar 92 and central grip 97 between the arms 78 and 80. He pulls the arms 78 and 80 downwardly against the action of the piston 108, thus exercising the latissimus dorsi, serratus anterior, intercostals and biceps muscles.

The lat pulldown (rear) exercise is done with the parts in the same relative dispositions as just mentioned, and in this case the person exercising straddles and sits on the bench 38 facing to the rear (away from the standpipe 56); and he pulls the bar 92 downwardly using the handle grips 94 and 96 back of his head. This exercises the latissimus dorsi, teres major and teres minor muscles.

The tricep pushdown exercise is also accomplished with the piston-cylinder assembly 98 extending upwardly, with the closure 106 being at the top. The assembly A is moved downwardly slightly on the standpipe 56 in comparison with its position for the lat pulldown (rear) exercise, and the bench 38 is declined. Thus, the arms 78 and 80 are nearly horizontal, and the person exercising stands, faces forwardly and pushes the bar 92 at its center on grip 97 downwardly against the action of the piston 108 flexing the elbows in particular. Thus, the triceps muscles are exercised.

With the sit-up and leg lift exercises, the assembly A is rotated through 180 degrees and is located substantially at its lowermost limit of movement against the tube 32. Thus, the bar 92 and handles 94 and 96 are located forwardly of the standpipe 56 so that they do not overlie the bench 38 or any part of it. The bars 120 and 122 are at this time located slightly forwardly of the standpipe 56, at a position slightly above the tube 48; and the bench 38 is declined and rests on the insert tube 54. The person exercising sits on the forward end of the pad 44 and puts his toes underneath the grips 128 and 130. Then, with his hands positioned behind his head, he does the sit-up exercise, alternately lying down backwardly on the pad 44 and raising himself so that his trunk is vertical. This exercises the rectus abdominus and the internal and external obliques muscles, and the declining disposition of the bench 38 allows a more concentrated stomach muscle workout.

For the leg lift exercise, the parts of the exerciser are in the same positions as just described in connection with the sit-up exercise. In this case, the person lies with his back on the bench pad 44 and grips the grips 128 and 130 with his hands. He then raises himself from a prone position to an upraised position in which his feet touch the standpipe 56. Thus, the rectus abdominus and the internal and external obliques muscles are exercised.

Advantageously, the assembly A and all of its working components, arms 78 and 80, and piston-cylinder assembly 98 are attached together and to the single tube 62 which is slideable on and removeable from the standpipe 56. Thus, the assembly A may be easily adjusted up or down on the standpipe 56 to facilitate differing heights of exercise bar 92 necessary to complete each exercise requiring upward lifting resistance (in which the piston-cylinder assembly 98 depends downwardly from its pivot 100 as shown in the drawings). The assembly A can thus also be lifted off of standpipe 56 and inverted to allow for pulling down exercises (lat pulldowns, front and rear, and tricep pushdown). The all-in-one compactness of the assembly A with the simplicity of height adjustment on the standpipe 56 and adjustment of resistance using valve 150 along with the versatility. of the exerciser in allowing all of the 17 previously mentioned exercises (along with many others) are considered points of importance of the present invention.

As will be noted from FIGS. 1 and 3, the pivotal connection 132 through which the piston 108 exerts its restraining force on the arms 78 and 80 moves from its position shown in FIG. 3 to a lowermost position (see FIG. 1) in which the tube 136 is nearly in contact with the upper head 104 of the piston-cylinder assembly 98, with the mid-point of this movement of the pivotal connection being at about the same level as the rod 84 constituting the pivot for the arms 78 and 80 (see FIG. 3). The advantage of this construction is that substantially the same restraining force is exerted by the piston 108 on the exercise arms 78 and 80 for the complete movement of the arms, so that the exercising action is the same throughout. This may be contrasted to the action of elastic bands used in some prior art structures on exercising arms the restraining force from which increases as the bands are elongated by the continued movement of the exercising arm. For my constant force action, the long exercising arms 78 and 80 are pivoted on the remote side of the upstanding post or standpipe 56, and the piston-cylinder assembly is on the other side of the post and extends parallel with the post and has pivotal attachments with the post and arm, and with the mid-point of travel of the pivotal connection 132 for the piston rod 110 being at about the same level as the pivot 82 of the arms 78 and 80.

As has been mentioned, the piston-cylinder assembly 98 may be inverted on the standpipe 56. The inversion is important in connection with the piston-cylinder assembly of the particular type shown which is one in which the piston 108 may freely move in the cylinder 102 in one direction but is impeded in its movement in the other direction, so that the two types of exercise may be had with movement of the arms 78 and 80 against restraint both up and down. It will be noted that the standpipe 56 is round so that the piston-cylinder assembly may also be rotated to move the exercise arms 78 and 80 from a position over the platform 36 for certain exercises.

Referring to FIG. 4, it is apparent that the width of the cylinder 102 and its head 104 is about the same as the spacing between the bars 40 and 42, and these dimensions are apparent from the fact that the width of the head 104 is shown in FIG. 4 as the diameter of the standpipe 56 plus two thicknesses of the tube 62, while the spacing of the bars 40 and 42 is shown in FIG. 1 as being also the diameter of the standpipe 56 plus two tube thicknesses; and as above stated, the bars 40 and 42 swing about the pivot 46 and thus about the outer tube 32, so that the whole bench may decline with the prop 50 removed. Therefore, the piston-cylinder assembly 98 may be moved downwardly between the spaced bars 40 and 42 of the bench 38 which is important for some exercises in which the bars 78 and 80 are at relatively low levels.

It will be noted that the pivot rod 84 of pivot 82 is located a substantial distance from the standpipe 56, being on the ends of the braces 64 and 66, and as shown in FIG. 1 in particular is located about ¼ of the distance that the handles 94 and 96 are located from the center of the standpipe 56. Also, it will be noted that the relatively heavy piston-cylinder assembly 98 is located quite close to the tube 62 on the opposite side from the pivot 82. Thjese expedients ensure a near balance of the head and cylinder assembly A and the tube 62 slideably mounted on the standpipe 56 allowing the tube 62 to move as freely as possible up and down the standpipe 56 without binding when the arms 78 and 80 are being adjusted vertically for different exercises. This balance is particularly important, since a hydraulic means (the piston-cylinder assembly 98) is used for restraining the movement of the exercise arms 78 and 80 in their exercising motions as contrasted with springs or resilient bands for restraining motion of associated exercise arms. The tension from such bands or springs is constant, while a piston-cylinder assembly gives no restraint without accompanying movement, and this is particularly true when motion of the piston 108 in one direction is substantially free due to the valve disk 112 which open the holes 118 for one direction of movement of the piston 108. With the piston-cylinder assembly 98, when the arms 78 and 80 are being adjusted vertically for different exercises, the piston rod 110 would begin to pull out of the cylinder tube 102 thwarting the balance effort and causing a binding of the tube 62 on the standpipe 56, unless of course the valve 150 is closed for the maneuver which would be time consuming and troublesome for the many times that the height of the arms 78 and 80 are adjusted in an ordinary exercise routine. This balance of the head and cylinder assembly A is thus important.

It will be noted from FIG. 3 that the set pin 68 is located in close proximity to the pivot 82. Therefore, the pivot 82 and particularly the tube 86 of the pivot 82 may be used as an anchor or fulcrum for the palm of one hand when a height adjustment of the tube 62 and the arms 78 and 80 is being made to allow the fingers of this hand to pull the set pin 68 outwardly to disengage it from the standpipe 56 using the enlarged head of the set pin 68. The pivot 82 in this case also acts as a weight bearing handle, and the opposite hand is placed on the handle 130 for lifting the arms 78 and 80 and the tube 62 upwardly using the two hands. The location of the handle 130 close to the tube 62 and opposite to the pivot 82 and extending in the same direction as the pivot rod 84 for this purpose is thus advantageous. With the two hands thus supporting the assembly A on the opposite sides of the standpipe 56, the tube 62 can be easily balanced and kept in alignment with the standpipe 56 for easy up and down adjustments without binding.

The set screw 76 in the tube 62 ensures safety and eliminates the play between the tube 62 and the standpipe 56 during exercising. This is important in connection with the piston-cylinder assembly 98 for resisting the movement of the arms 78 and 80, since the piston-cylinder assembly 98 is effective to resist arm movement only when the arms are in actual movement and provides no resistance when there is no arm movement. Without such a set screw, the tube 62 may wiggle back and forth on the standpipe 56 when the arms 78 and 80 are being moved up and down with exercising, while in the case of constant tension springs or elastic bands used for restraining movement of exercising arms such a wiggling of a tube corresponding to the tube 62 would not occur.

I claim:

1. Athletic exercise apparatus comprising a ground-supported base and a stationary upstanding post carried by and extending upwardly from said base with the base being mainly on an exercise side of said post, an exercise arm supported by and having a pivotal connection with respect to said post with the axis of the pivot of the pivotal connection being horizontal whereby the arm can be swung by the user of the apparatus toward and away from the main portion of the base, said pivot being spaced horizontally from said post in the direction opposite from said main portion of said base, and a hydraulic piston-cylinder assembly extending substantially parallel with said post and having pivotal connections with said arm and said post and spaced from said post on the side of the post above said main portion of said base with the connection of the piston-cylinder assembly with said arm traversing from a position at a level higher than said pivot to a position at a level lower than said pivot and with the mid-point of travel of said connection of said piston-cylinder assembly and arm being about at the same level as said pivot as the piston moves longitudinally in said cylinder from one end of the cylinder to the other for restraining the swinging movement of said arm about said pivot so that force can be put manually on said arm to move it against the hydraulic action of said piston-cylinder assembly to thereby exercise the user of the apparatus.

2. Athletic exercise apparatus comprising a ground-supported base and a stationary upstanding post carried by and extending upwardly from said base with the base being mainly on an exercise side of said post, an exercise arm supported by and having a pivotal connection with respect to said post with the axis of the pivot of the connection being horizontal whereby the arm can be swung by the user of the apparatus toward and away from the main portion of the base, said pivot being spaced horizontally from said post in the direction opposite from said main portion of said base, a hydraulic piston-cylinder assembly extending along side of said post on the side of the post above said main portion of said base and having pivotal connections with said arm and said post, said piston-cylinder assembly being of such construction that the piston is materially impeded in traversing said cylinder in one direction but may freely move in said cylinder in the opposite direction in the cylinder so that said arm is not impeded for one direction of swing but is impeded for the other direction of swing for exercising the user of the apparatus, said post being round in cross section, and a tube for supporting said pivot and said piston-cylinder assembly and said arm and fitting about said post so that said arm may be swung about the longitudinal center of the post to position the arm out of position over said main portion of the base and whereby said arm and said piston-cylinder assembly can be inverted on said post so that the piston-cylinder assembly operates in an opposite way to impede the motion of said arm oppositely in the impedance of motion of the arm by said piston-cylinder assembly before the inversion.

3. Athletic exercise apparatus comprising a ground-supported base and a stationary upstanding post carried by and extending upwardly from said base with the base being mainly on an exercise side of said post, an exercise arm supported by and having a pivotal connection with respect to said post with the axis of the pivot of the connection being horizontal whereby the arm can be swung by the user of the apparatus toward and away from the main portion of the base, said pivot being spaced horizontally from said post in the direction opposite from said main portion of said base, a hydraulic piston-cylinder assembly extending along side of and parallel with said post on the side of the post above said main portion of said base and having pivotal connections with said arm and said post for restraining swinging movement of said arm, a tube disposed over and slidable on said post and supporting said piston-cylinder assembly and said arm and said pivot, means for selectively fixing said tube and thereby said piston-cylinder assembly and said pivot and said arm at different vertical locations on said post, and a bench extending over said base on the exercise side of said post and comprising two spaced support bars connected with said post, the thickness of said cylinder overall horizontally being about the same as the spacing of said bars horizontally so that the piston-cylinder assembly can pass downwardly between said bars as said tube is moved downwardly on said post.

4. Athletic exercise apparatus comprising a stationary upstanding standpipe, a tube surrounding said standpipe and slidably disposed thereon, a brace member fixed with respect to said tube and extending a substantial distance outwardly from said tube, an exercise arm mounted on the end of said brace member by means of a pivot that is thus disposed at a substantial distance on one side of said tube and standpipe and extending across said standpipe and tube and having a handle on its end remote from said pivot, the length of said arm between said standpipe and said pivot being a substantial part of the complete length of the arm and the length of the part of the arm between said standpipe and said handle being a few times greater than the length of the part of said arm between said standpipe and said pivot, a hydraulic piston-cylinder assembly extending along side of said standpipe on the side of said standpipe remote from the side of said pivot and being connected to said exercise arm on one end and with respect to said tube on the other end for causing restraint of movement of said exercise arm as it is moved up and down in exercising motion, and a set pin for fixing said tube in a number of adjusted vertical positions on said standpipe.

5. Athletic exercise apparatus as set forth in claim 4, said piston-cylinder assembly being located closer to said standpipe than said pivot on the other side of said standpipe and said brace member extending from said tube to the side of the tube on which the piston-cylinder assembly is located and said piston-cylinder assembly on this side of the tube and the other end of the piston-cylinder assembly being pivotally connected to said arm.

6. Athletic exercise apparatus as set forth in claim 4, said set pin extending from said tube and standpipe toward said pivot for said exercise arm and being in close proximity to said pivot for said exercise arm so that the fingers of one hand of a person can reach and manipulate the set pin while resting with the palm of the hand on said pivot for said exercise arm.

7. Athletic exercise apparatus as set forth in claim 4, said brace member extending a substantial distance from said tube in the direction away from said pivot for said exercise arm, and a handle fixed with respect to said brace member on its end remote from said pivot and extending in the same direction as the axis of said pivot so that one hand may be usd on this handle and the other hand may be used on said pivot for moving said tube and said arm and said piston-cylinder assembly vertically on said standpipe when said set pin is released.

8. Athletic exercise apparatus as set forth in claim 4, said set pin including a spring for forcing said pin into pin receiving openings provided in said standpipe for releasably holding said tube in vertically located positions on said standpipe, and a set screw carried by said tube for fixing said tube on said standpipe once said tube has been located vertically on the standpipe by said set pin.

* * * * *